United States Patent [19]

Paul et al.

[11] 4,079,792

[45] Mar. 21, 1978

[54] MINE ROOF SUPPORT FOR A MOBILE DRILLING MACHINE

[75] Inventors: Edwin B. Paul, Fairmont, W. Va.; Roy R. Denham, San Jose, Calif.

[73] Assignee: Mining Equipment Division, a division of FMC Corporation, Fairmont, W. Va.

[21] Appl. No.: 806,624

[22] Filed: Jun. 15, 1977

[51] Int. Cl.[2] ..... E21C 11/02; E21C 27/22

[52] U.S. Cl. ..... 173/23; 61/63; 173/34; 173/38; 175/219

[58] Field of Search ..... 61/45 D, 45 R, 45 B, 61/63; 182/112; 175/219, 213; 299/10, 11, 31–33; 173/23–28, 52, 38; 280/150 F, 150 R, 150.5, 156; 296/68, 65 A

[56] References Cited

U.S. PATENT DOCUMENTS

| | | | |
|---|---|---|---|
| 3,768,574 | 10/1973 | Long | 175/219 X |
| 3,865,197 | 2/1975 | McCormick | 173/23 |
| 3,893,520 | 7/1975 | McCormick | 175/219 X |
| 3,937,517 | 2/1976 | Donovan et al. | 296/68 |
| 3,951,215 | 4/1976 | Galis | 173/23 |
| 4,022,026 | 5/1977 | Childress | 61/63 |
| 4,026,118 | 5/1977 | McCay | 61/63 |

*Primary Examiner*—Dennis L. Taylor
*Attorney, Agent, or Firm*—Stanley J. Price, Jr.; John M. Adams

[57] ABSTRACT

A horizontal deck extends forwardly from a self-propelled body portion. An elevating mechanism pivotally connects the deck to the body portion for vertical movement of the deck into and out of position on the mine floor. A mast-type roof drilling unit is mounted on the front of the deck and includes a vertically movable drill pot for advancing a rotating drill rod into the mine roof for drilling a bore hole therein. The deck is positioned on the mine floor during the drilling operation. During tramming of the body portion the deck is raised to an elevated position above the mine floor. A roof support assembly is supported by telescoping devices above the deck to provide overhead protection for the machine operator during the drilling and tramming operations. During drilling the roof support assembly is raised to abut the mine roof and support the mine roof above the operator on the deck. To facilitate tramming the body portion, the deck is lowered from the mine roof a sufficient distance to permit raising the deck from the mine floor.

10 Claims, 2 Drawing Figures

MINE ROOF SUPPORT FOR A MOBILE DRILLING MACHINE

BACKGROUND OF THE INVENTION

1. Field of the Invention

This invention relates to a roof support for a mobile mine drilling machine and more particularly to a roof support for protecting the drill operator and operatively mounted to facilitate tramming of the machine and positioning to support the mine roof during roof drilling and bolting operations.

2. Description of the Prior Art

In underground mining, it is the present practice to support the roof of the excavated or mined areas with roof bolts that are inserted in holes drilled in the mine roof. The roof bolts serve to tie the overhead strata of different materials to each other and reduce horizontal shifting or sliding of the different strata relative to each other. This manner of roof support minimizes the possibility of sections of the roof falling and injuring personnel in the mine. The roof bolts hold rectangular bearing plates in place adjacent the surface of the roof to provide additional bearing support for the roof.

In order to provide the desired roof support by bolting, it is necessary to form bore holes to a given depth in the roof with a roof drill. The depth of the bore hole may vary from several feet to ten feet or more, depending on the type of strata located above the roof. It is essential that the bore hole terminate in a stratum that provides a good anchor for the expansion member on the roof bolt. It is the conventional practice to drill a plurality of holes in a given arrangement across the entry at spaced intervals in the mine roof to provide a standard bolt pattern. To this end the roof drill is maneuvered in the mine entry for drilling bore holes at preselected locations in the mine roof by a self-propelled vehicle.

In one embodiment the roof drill, such as a rotary or a rotary percussion type, is pivotally connected to a forwardly extending boom that is connected to the body of the self-propelled vehicle. A suitable linkage mechanism raises and lowers the boom to vertically raise the drill to the required elevation to drill a bore hole to a preselected depth in the mine roof. It is also known to drill bore holes in accordance with a preselected bolt pattern by a mast-type drill that is mounted for slidable vertical movement on a mast supported on the body of the self-propelled vehicle. Suitable hydraulic devices are operable to vertically raise the mast together with the drill into drilling position adjacent the mine roof. The lower portion of the mast is stabilized on the mine floor to brace the drill as it is vertically raised to drill a bore hole in the mine roof.

The conventional roof drilling operation involves drilling of an unsupported section of the mine roof, and, after periods of continual drilling, a section of the unsupported roof could be sufficiently weakened to the extent that the roof could collapse resulting in serious injury to the operating personnel and damage to the drilling machine. Therefore, it is known to provide protective canopies for drilling machines as disclosed in U.S. Pat. No. 3,865,197 illustrating a protective canopy for a mobile-type drilling machine.

There is need for a roof support associated with a mobile mast-type drilling machine that provides overhead roof support for the drill operator when the mast-type drill is moved into roof drilling position and a roof support arrangement that may be transported by the self-propelled vehicle when the drill is moved to preselected locations in the mine entry.

SUMMARY OF THE INVENTION

In accordance with the present invention there is provided in a mobile drilling machine, a self-propelled body portion having an operator's platform projecting forwardly of the body portion. The operator's platform has a front end portion and a rear end portion. A roof drilling unit is mounted on the front end portion of the operator's platform and has a drill member extending upwardly therefrom and is operable to drill bore holes in a mine roof. An elevating mechanism connects the rear end portion of the operator's platform to the machine body portion to move the operator's platform to a first position on the ground for drilling operations and to a second position raised from the ground for tramming of the body portion with the operator's platform secured thereto. An actuating device is connected to the elevating mechanism and is operable to move the operator's platform between the first position and the second position. A roof support assembly is supported above the operator's platform and is operable to engage the mine roof to support the mine roof when the operator's platform is in the first position. The roof support assembly is movable on the operator's platform out of contact with the mine roof when the operator's platform is in the second position.

Adjusting devices are positioned on the operator's platform and are operable to raise the roof support assembly in abutting relation with the mine roof. The adjusting devices are connected at one end portion to the roof assembly to support the assembly above the operator's platform. The adjusting devices are operable to maintain the roof supporting assembly in abutting relation with the mine roof when the operator's platform is lowered to the first position. Further, the adjusting devices are operable to lower the roof support assembly out of abutting relation with the mine roof when the operator's platform is raised to the second position. With this arrangement, the adjusting devices are operable to support the roof support assembly above the operator's platform and move from abutting relation with the mine roof to the second position for tramming of the machine body portion.

Preferably, the adjusting devices include a plurality of telescoping mechanisms mounted on the operator's platform at preselected locations substantially the entire length thereof. Each of the telescoping mechanisms has a base portion rigidly secured to the operator's platform and an extensible portion concentrically positioned in the base portion having an upper end portion arranged to vertically extend and retract relative thereto. The end portions of the telescoping mechanisms are connected to the roof support assembly to support the assembly above the operator's platform. The telescoping mechanisms vertically raise the roof support assembly into abutting relation with the mine roof when the operator's platform is lowered to a position on the mine floor.

The roof support assembly includes a generally rectangular frame that extends substantially the length of the operator's platform and is arranged to abut the mine roof along the entire length thereof. The frame supports a protective canopy that comprises a plurality of interconnected transverse and longitudinal beam members that provide a roof bearing surface arranged to engage the mine roof to support the mine roof during the roof drilling operations. The roof support frame is raised and lowered by the telescoping mechanisms to move the beam members into and out of roof supporting position.

The roof support frame overlies the roof drilling unit which is preferably a mast-type roof drill. An opening in the plurality of transverse and longitudinal beam members above the drill permits the drill rod to move vertically through the opening and into the strata of the mine roof. A protective shield or cage positioned on the front end portion of the operator's platform extends forwardly of and in surrounding relation with the drilling unit. The protective shield extends upwardly from the operator's platform and outwardly from beneath the roof support assembly. With this arrangement the roof drilling unit is surrounded laterally and vertically by the protective shield and the roof support assembly respectively.

The operator's platform is movably supported by the machine body portion by the elevating mechanism that includes a linkage connecting the rear end portion of the operator's platform with the machine body portion. The linkage is pivotally connected at one end portion to a transversely extending support plate that extends upwardly from the rear end portion of the operator's platform. The opposite end portion of the linkage is connected to the machine body portion.

The actuating device includes a lift jack having a cylinder pivotally connected to the machine body portion and an extensible piston rod that is connected intermediate the end portions of the linkage. The lift jack, upon retraction of the piston rod, pivots the linkage downwardly relative to the body portion to lower the operator's platform to the first position for roof drilling operations. The lift jack, upon extension of the piston rod, pivots the linkage upwardly relative to the body portion to raise the operator's platform to the second position for tramming of the machine body portion.

Accordingly, the principal object of the present invention is to provide a self-propelled mine roof drilling machine that includes a mast-type roof drill supported on an operator's platform that extends forwardly of the body portion and is arranged to be raised to a tramming position and lowered onto the ground during the drilling operations with a roof support assembly mounted on the operator's platform and movable into and out of roof supporting position.

Another object of the present invention is to provide a mast-type drilling assembly mounted on a self-propelled vehicle maneuverable in a mine entry for drilling bore holes in the mine roof and including a roof support assembly for protecting the machine operator while the machine is being trammed and in position during drilling operations.

These and other objects of the present invention will be more completely disclosed and described in the following specification, the accompanying drawings and the appended claims.

DESCRIPTION OF THE PREFERRED EMBODIMENT

Figure 1:
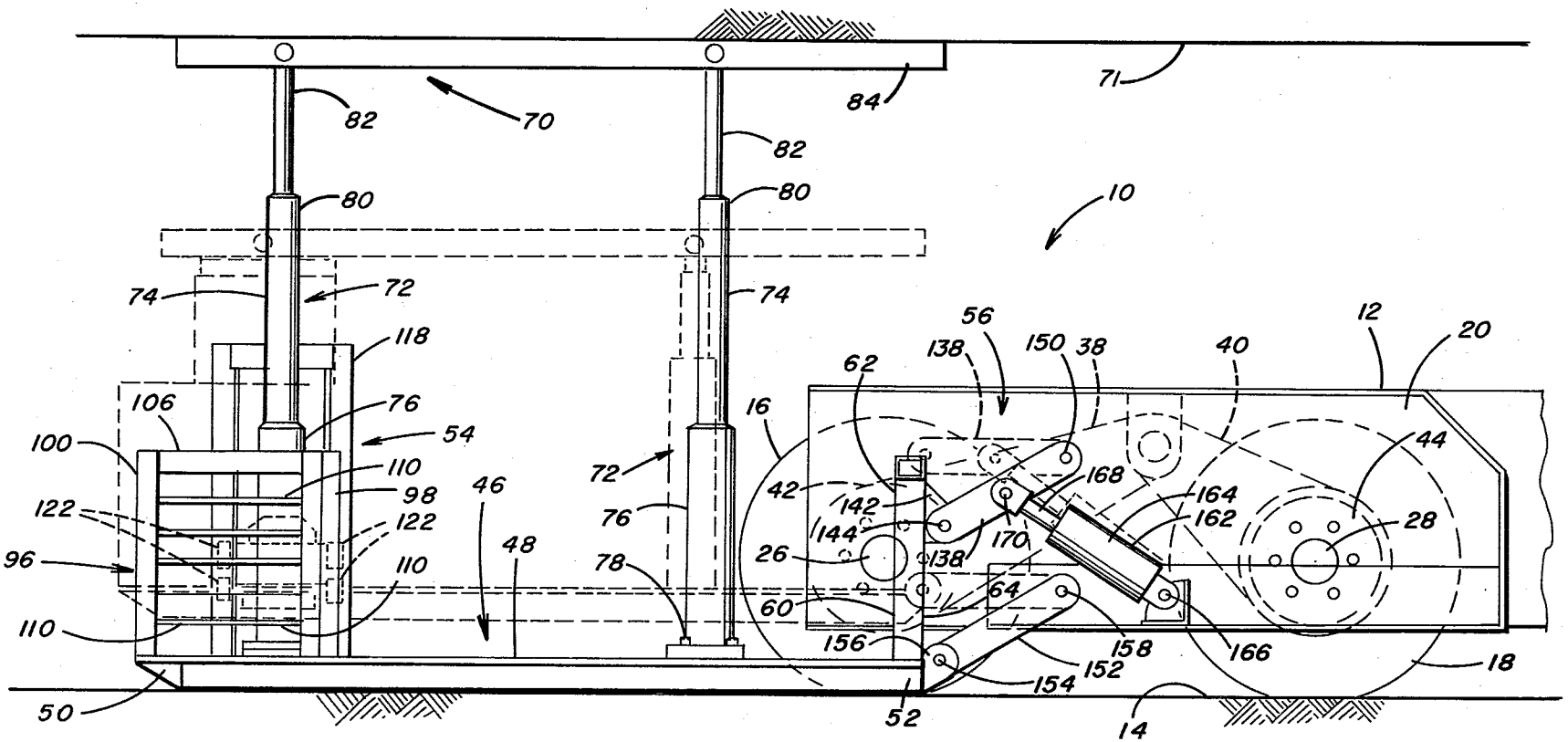
FIG. 1 is a fragmentary view in side elevation of a self-propelled mine drilling machine, illustrating a mast-type roof drill mounted on a vertically movable operator's platform connected to a body portion with a vertically movable roof support assembly supported above the operator's platform.

Referring to the drawings, there is illustrated a mobile mine roof drilling machine generally designated by the numeral 10 that includes a self-propelled body portion 12 that is trammed along the mine floor 14 on pairs of wheels 16 and 18. The body portion 12 includes a pair of parallel side plates 20 vertically supported to a horizontal platform 22. The front wheels 16 are rotatably mounted on the body portion 12 by axles 26 that are supported by the side plates 20. In a similar arrangement, the rear wheels 18 are rotatably mounted on the body portion 12 by axles 28 that are supported by the side plates 20.

The wheels 16 and 18 are conventionally driven, as for example, by an electric motor 19 supplied with power through an electric cable wound upon a cable reel that is rotatably mounted on the horizontal platform 22 or by a hydraulic motor which receives fluid under pressure from a hydraulic pump suitably mounted on the horizontal platform 22 where the hydraulic pump is driven by a motor. Preferably, drive is transmitted from the propelling motors 19, one mounted on each side of the platform 22, to a speed reducer 30 having an output shaft 32. Sprockets 34 and 36 on the output shaft 32 carry chains 38 and 40 respectively which drive sprockets 42 and 44 on the front and rear wheels 16 and 18. With this arrangement the pairs of wheels (a wheel 16 and a wheel 18) on each side of the body portion are independently driven to permit steering of the machine.

The machine body portion 12 carries an operator's platform generally designated by the numeral 46 that extends forwardly from the body portion 12 and includes a generally horizontal deck 48 having a front end portion 50 and a rear end portion 52. A roof drilling assembly generally designated by the numeral 54 of the mast type is positioned on the front end portion 50 of the operator's plargorm 46 for movement with the platform 46 to a first position where the deck 48 is positioned on the mine floor during drilling operations and to a second position where the deck 48 is raised from the mine floor for tramming of the machine body portion 12. The rear end portion 52 of the operator's platform 46 is connected to the body portion 12 by an elevating mechanism generally designated by the numeral 56. The elevating mechanism moves the deck 48 into and out of the first position on the mine floor for drilling operations.

Figure 2:
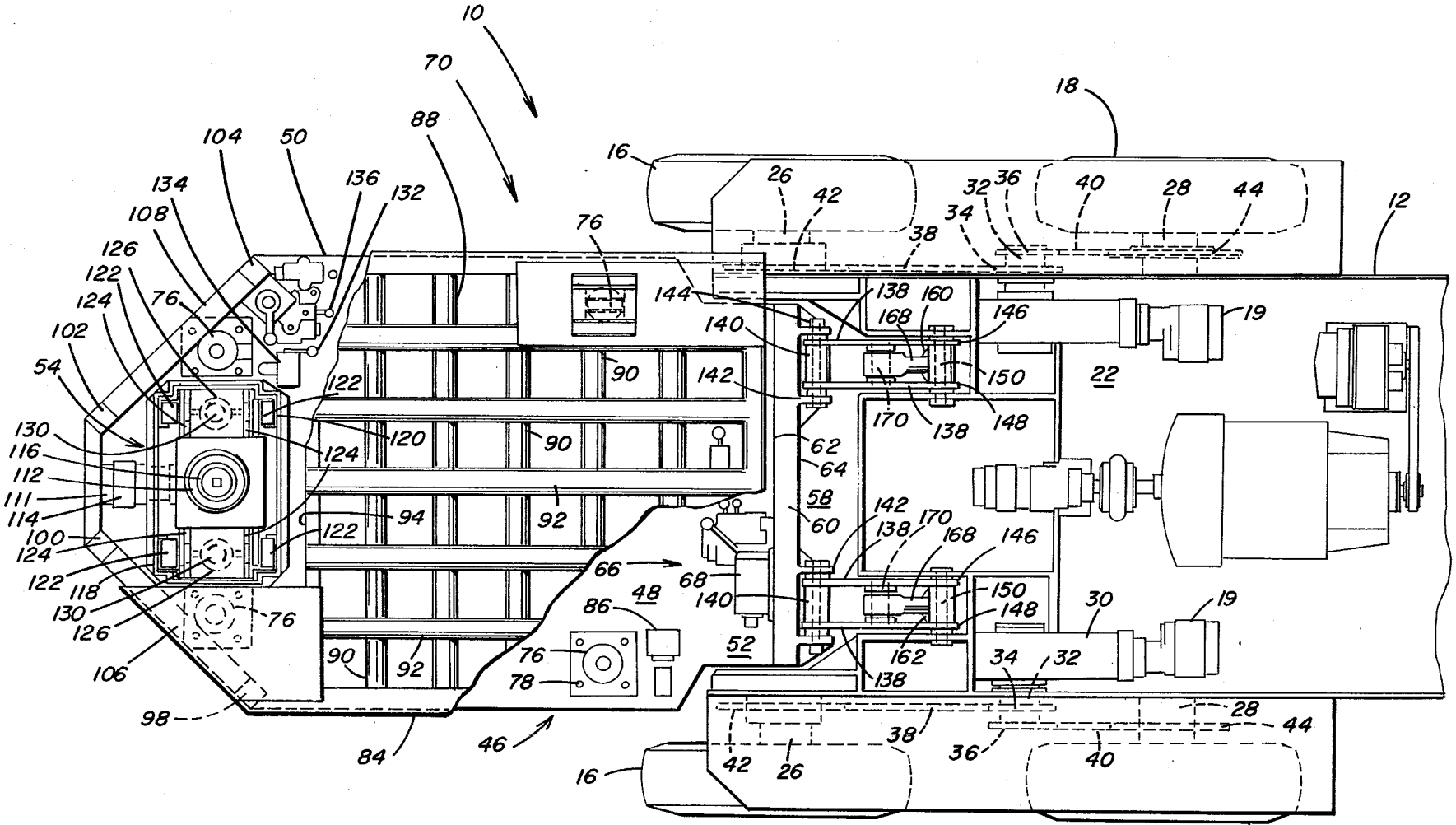
FIG. 2 is a fragmentary top plan view of the self-propelled mine drilling machine shown in FIG. 1, illustrating the gridwork of the roof support assembly positioned above the operator's platform and surrounding the roof drill.

The front end portion of the machine body portion 12 is provided with a recess 58. The recess 58 extends substantially the width of the body portion 12 between the front wheels 16. The operator's platform 46, as illustrated in FIG. 2, has a substantially rectangular configuration where the front end portion 50 is tapered and the rear end portion 52 has a reduced width for positioning within the recess 58. A support plate 60 is positioned transversely on the rear end portion of the operator's platform 46 and extends upwardly from the deck 48 within the recess 58. The support plate 60 has a front wall 62 and a rear wall 64. The elevating mechanism 56 is connected at one end portion to the rear wall 64 and at the opposite end portion to a suitable pivot arrangement on the machine body portion 12, in a manner to be described later in greater detail.

An operator's compartment generally designated by the numeral 66 is provided on the deck 48 at the rear end portion 52 with suitable controls 68 mounted on the front wall 62 of support plate 60 for controlling tramming of the machine body portion 12, such as starting, stopping and turning the body portion. In addition, the machine operator is capable of controlling actuation of the elevating mechanism 56 by the controls 68 from the operator's compartment 66. In this manner the operator, while positioned at the operator's compartment 66 lowers the deck 48 to a position resting on the mine floor. With the deck 48 positioned on the mine floor, the roof drilling unit 54 is stabilized to perform the roof drilling and bolting operations.

When a bore hole has been drilled and a roof bolt assembly installed therein, the machine operator actuates the elevating mechanism 56 from the operator's compartment 66 to raise the deck 48 to an elevated position above the mine floor 14. In this position the machine body portion 12 with the operator's platform 46 secured thereto is trammed to the next drilling location. Positioning the operator's compartment 66 at the rear end portion 52 provides the operator with ready accessibility to the roof drilling unit 54 when the machine body portion is stopped and the deck 48 lowered onto the mine floor. This permits the operator to freely move from the operator's compartment 66 on the platform 46 to the front end portion 50 where the drilling unit 54 is located. Thus the machine operator can efficiently control both the roof drilling and bolting operations and tramming of the machine from the operator's platform 46.

A roof support assembly generally designated by the numeral 70 is supported by a plurality of adjusting devices 72 above the operator's platform 46 at a preselected height above the roof drilling unit 54 and the operator's compartment 66. The adjusting devices are mounted on the horizontal deck 48 at one end portion and are connected at the opposite end portion to the roof support assembly 70 to support the assembly 70 above the deck 48. The adjusting devices are operable to vertically raise the roof support assembly 70 into position abutting the mine roof 71. However, during tramming of the machine body portion 12 the roof support assembly 70 is lowered to a position removed from contact with the mine roof.

To position the drilling unit 54 for roof drilling, the deck 48 is lowered by the elevating mechanism 56 onto the mine floor 14. The adjusting devices 72 are then actuated to vertically raise the roof support assembly 70 against the mine roof. Thus, with the deck 48 positioned on the mine floor, the adjusting devices 72 are stabilized to maintain the roof support assembly 70 in a roof supporting position.

Each of the adjusting devices includes a telescoping mechanism 74 having a base or cylinder portion 76 secured to the horizontal deck 48 by bolts 78. An extensible portion 80 is concentrically positioned in the base portion 76 and has an upper end portion 82 arranged to vertically extend and retract relative to the base portion 76. The upper end portion is securely pinned to a generally rectangular frame 84 of the roof support assembly 70. Each of the telescoping mechanisms 74 is hydraulically operated. A valve device 86 located at the operator's compartment 66 on the platform 46 is operable to control the flow of fluid under pressure from a fluid pump (not shown) on the machine body portion 12 through conduits to the cylinder portions of the mechanisms 74. The extensible portions 80 are extended to raise the roof support frame 84 into abutting relation with the mine roof. Accordingly, the valve 86 is operated to actuate the mechanism 74 to lower the frame 84 from contact with the mine roof to a suitable tramming position. In this manner the roof support assembly 70 is raised and lowered above the operator's platform 46.

The frame 84 of the roof support assembly 70 supports a gridwork 88 of a plurality of transverse tubular members 90 connected to a plurality of longitudinal tubular members 92 to form a roof support canopy that serves as a roof bearing surface that when positioned in abutting relation with the mine roof supports the mine roof when the drilling unit is operated to drill bore holes and install roof bolt assemblies in the mine roof. This arrangement protects the operator against the hazards of a roof fall during the roof drilling and bolting operations.

The gridwork 88 of the transverse and longitudinal members 90 and 92 extends the entire length of the deck 48 above the platform 46. As illustrated in FIG. 2, the front end portion 50 of the deck has a tapered configuration, and the portion of the gridwork supported above the deck also has a tapered configuration. With this arrangement the roof support assembly 70 overlies the peripheral boundaries of the deck 48.

Further, as illustrated in FIG. 2, the gridwork 88 includes an opening 94 overlying the roof drilling unit 54 to permit the drill member to extend through the opening 94 and advance upwardly into the mine roof strata. The opening 94 is sufficient to permit vertical movement of the drill but provide the area of the operator's platform 46 adjacent the roof drilling unit 54 with overhead roof support. Thus, the drill operator is protected at all times during the drilling operation by the roof support assembly 70 abutting the mine roof.

A protective shield or cage generally designated by the numeral 96 is positioned on the front end portion 50 of the deck 48 in surrounding relation with the roof drilling unit 54. The protective shield 96 is rigidly secured to the deck 48 and extends upwardly therefrom and forwardly of the overlying roof support frame 84. The shield 96 extends to a preselected height above the deck 48 so as not to interfere with the vertical movement of the roof support assembly 70.

The protective shield 96 includes a plurality of vertical supports 98, 100, 102 and 104 that are securely mounted on the platform 48 on the periphery thereof at the front end portion 50. The upper end portions of the pairs of vertical supports 98–100 and 102–104 are connected by horizontal brace members 106 and 108, respectively. A plurality of parallel, spaced horizontally extending bars 110 are secured at their end portions to the pairs of vertical supports 98–100 and 102–104 and are spaced vertically between the brace members 106, 108 and the horizontal platform 48. A similar arrangement of parallel, spaced horizontally extending bars 111 are secured to and extend between the adjacent vertical supports 100 and 102. In this manner the roof drilling unit 54 is surrounded by a cage-like structure at the front end portion 50 of the operator's platform 46. This arrangement protects the unit 54 from damage due to collision with surrounding objects during tramming of the machine body portion 12.

The roof drilling unit 54 preferably is a mast-type drill unit that includes a drill pot 112 driven by a suitable motor 114 for rotating a drill rod that is retained within a rotatable chuck 116 of the drill pot 112. The drill pot 112 is mounted for slidable vertical movement on a mast 118. The mast 118 includes vertical guideways 120 that are arranged to receive rollers 122 that are rotatably supported by plate members 124 that are secured to and extend outwardly from the drill pot 112. A pair of hydraulic cylinders 126 is mounted on the horizontal deck 48 and each includes an extensible piston 130 that is suitably pinned to the plates 124. Means may also be provided to ensure vertical movement of the pistons 130.

The hydraulic cylinders 126 are controlled by a lever 132 of a hydraulic control device 134 associated with the drilling unit 54 so that upon actuation of the cylinders the pistons 130 extend and thereby raise the drill pot 112 on the mast. This raises the drill head to a position to start the bore hole in the mine roof. When the drill pot has been raised to the position to start the bore hole, the motor 114 is actuated by controls 136 positioned beneath the roof support assembly 70 to rotate the drill. Further extension of the pistons 130 raises the drill pot to advance the rotating drill head into the roof strata. Once a bore hole of a preselected depth has been drilled in the mine roof, the drill rod is retracted by lowering the drill pot on the mast 118. The drill rod is then removed from the chuck 116 and replaced with a roof bolt assembly. The drill pot 112 is then vertically raised on the mast 118 as above described to install the roof bolt assembly in the bore hole. The opening 94 in the gridwork 88 is sufficiently large to permit the roof bolt and bearing plate mounted on the roof bolt to pass through the gridwork 88 into position abutting the surface of the roof.

Upon completion of drilling a bore hole and installing a roof bolt assembly, assembly 70 is lowered from contact with the mine roof and the operator's platform 46 raised to an elevated position above the mine floor 14. The deck 48 with the roof support assembly 70 thereon is vertically raised relative to the machine body portion 12 by the elevating mechanism 56.

The elevating mechanism preferably includes a first pair of link arms 138, one of each positioned at opposite sides of recess 58 of the body portion deck 22. The arms are held in space relation at one end portion by a bridging web 140. Each pair of link arms 138 is pivotally connected to a clevis-type connection 142 that projects rearwardly from the rear wall 64 of support plate 60 at the upper end portion thereof by a pivot pin 144 that extends through aligned bores of the bridging web 140 and connection 142. The opposite end portions of each of the link arms 138 are pivotally connected to a pair of spaced, parallel plate members 146 and 148 that extend upwardly from the horizontal platform 22 of the machine body portion 12. A pivot pin 150 extends through a bridging web (not shown) extending between the arms 138 and holes in the plate members 146 and 148 to pivotally connect the end portions of the link arms 138 to the plate members 146 and 148 of the machine body portion 12.

Oppositely positioned pairs of link arms 152, similar to the pairs of link arms 138, pivotally connect the operator's platform 46 at the rear end portion 52 to the mobile body portion 12. The link arms are pivotally connected at one end portion by a pivot pin 154 that extends through a clevis-type connection 156 that projects rearwardly on opposite sides from the lower portion of the rear wall 64 of the support member 60. The opposite end portions of the link arms 152 are pivotally connected by a pivot pin 158 to the lower portion of the plate members 146 and 148 on the platform 22 below the pivotal connection of link arms 138 to the plate members 146 and 148. With this arrangement the pairs of overlying link arms 138 and 152 connect the operator's platform 46 to the machine body portion 12 for pivotal movement of the link arms about the fixed pivot pins 150 and 158 to raise and lower the platform 46 between an elevated position above the mine floor and a position on the mine floor.

The operator's platform 46 is raised and lowered by a pair of lift jacks 160 and 162 that are positioned between the plate members 146 and 148 extending upwardly from the platform 22 on opposite sides of the body portion 12. Each lift jack includes a cylinder portion 164 that is connected to a fixed pivot point on the mobile body 12 by a pin 166. A piston rod 168 extends from the opposite end of the cylinder portion 164 and the end portion of the rod 168 is connected by a pivot pin 170 intermediate the link arms 138. The end portions of the pivot pin 170 are rotatably journaled within the link arms 138.

The lift jacks 160 and 162 are preferably fluid operated by controls located at the operator's compartment 66 on the deck 48. The lift jacks 160 and 162 are operable in a first mode upon retraction of the piston rods 168 to swing the link arms 138 downwardly about the pivot pins 150 to, in turn, swing the link arms 152 downwardly about the pivot pins 158 and thereby move the deck 48 onto the mine floor 14. With the deck 48 stabilized on the mine floor the telescoping mechanisms are actuated to vertically raise the roof support frame 84 and the gridwork 88 into abutting relation with the mine roof. In this manner the mine roof above the operator's platform 46 is supported as a bore hole is drilled in the mine roof and a roof bolt assembly is installed in the bore hole.

In order to move the roof drilling unit 54 to the next location within the mine for installing a roof bolt, the telescoping mechanisms 74 are actuated to retract the roof support frame 84. The deck 48 is then raised to an elevated position, as illustrated in phantom in FIG. 1, to facilitate tramming of the machine body portion 12. Lifting of the deck 48 is accomplished by actuating the lift jacks 160 and 162 to extend the piston rods 168 and thereby swing the link arms 138 upwardly about the fixed pivot pins 150. The upward swinging movement of the link arms 138 is accompanied by upward swinging movement of the link arms 152 about the fixed pivot pins 158.

The piston rods 168 are maintained in an extended position to maintain the deck 48 in an elevated position above the mine floor 14 while the body portion 12 is trammed to the next location for roof drilling. Thus, it will be apparent from the present invention that roof drilling and bolting operations may be accomplished by tramming the mobile body portion 12 to move the drilling unit 54 to selected locations in the mine. By pivotally connecting the operator's platform 46 to the machine body portion 12 the roof drilling unit 54 is operably moved from place to place in the mine and stabilized by positioning the platform 46 on the mine floor during the roof bolting and drilling operations. Also the operator is protected at all times from the hazards of a roof fall by the overhead roof support assembly 70, particularly during the roof bolting and drilling operations when the gridwork 88 is raised to abut the surface of the roof.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A mobile drilling machine comprising, a self-propelled body portion an operator's platform extending forwardly of said body portion, said operator's platform having a front end portion and a rear end portion, a roof drilling unit mounted on said front end portion of said operator's platform and having a drill member extending upwardly therefrom and operable to drill bore holes in a mine roof, elevating means for connecting said rear end portion of said operator's platform to said body portion to move said operator's platform to a first position on the mine floor for drilling operations and to a second position raised from the mine floor for tramming of said body portion with said operator's platform secured thereto, actuating means connected to said elevating means for moving said operator's platform between said first position and said second position, and roof support means supported by said operator's platform for engaging the mine roof to support the mine roof when said operator's platform is in said first position, said roof support means being movable on said operator's platform out of contact with the mine roof when said operator's platform is in said second position.

2. A mobile drilling machine as set forth in claim 1 which includes, adjusting means positioned on said operator's platform for raising said roof support means in abutting relation with the mine roof, said adjusting means connected to said roof support means for supporting said roof support means above said operator's platform, and said adjusting means being operable to maintain said roof support means abutting the mine roof when said operator's platform is lowered to said first position.

3. A mobile drilling machine as set forth in claim 2 which includes, said adjusting means being operable to lower said roof support means from abutting relation with the mine roof when said operator's platform is raised to said second position, and said adjusting means being further operable to support said roof support means in a position removed from abutting relation with the mine roof with said operator's platform in an elevated position for tramming of said body portion.

4. A mobile drilling machine as set forth in claim 1 in which said roof support means includes, an overhead canopy extending substantially the length of said operator's platform and arranged to abut the mine roof along the entire length thereof, said canopy including a generally rectangular frame being supported for vertical movement above said operator's platform into and out of abutting relation with the mine roof, and a plurality of transverse and longitudinal support members secured to said frame to provide a roof bearing surface arranged to engage the mine roof to support the mine roof during roof drilling operations.

5. A mobile drilling machine as set forth in claim 4 which includes, said frame of said canopy surrounding said roof drilling unit, an opening in said plurality of transverse and longitudinal support members above said roof drilling unit, and said drill member supported by said roof drilling unit in underlying relation with said opening to permit vertical movement of said drill member through said opening.

6. A mobile drilling machine as set forth in claim 1 which includes, a plurality of telescoping devices mounted on said operator's platform at preselected locations substantially the entire length thereof, each of said telescoping devices having a base portion rigidly secured to said operator's platform and an extensible portion concentrically positioned in said base portion and having an end portion arranged to vertically extend and retract relative thereto, said end portions of said telescoping devices being connected to said roof support means to support said roof support means above said operator's platform, and said telescoping devices being operable to vertically raise said roof support means and position said roof support means in abutting relation with the mine roof when said operator's platform is positioned on the mine floor.

7. A mobile drilling machine as set forth in claim 1 which includes, a support member positioned transversely on said operator's platform and extending upwardly from said rear end portion thereof, said elevating means including a linkage mechanism positioned between said support plate and said body portion, said linkage mechanism being pivotally connected at one end portion to said support member and at the opposite end portion to said body portion, said actuating means including a lift jack having a cylinder pivotally connected to said body portion and an extensible piston rod connected intermediate the end portions of said linkage mechanism, said lift jack being operable to retract said piston rod and pivot said linkage mechanism to swing downwardly relative to said body portion and lower said operator's platform to said first position for operating said roof drilling unit, and said lift jack being operable to extend said piston rod and pivot said linkage mechanism to swing upwardly relative to said body portion and raise said operator's platform to said second position for tramming said body portion.

8. A mobile drilling machine as set forth in claim 1 which includes, said body portion having a front end portion with a recess therein extending substantially the width of said body portion, said rear end portion of said operator's platform being positioned within said recess of said body front end portion, an operator's compartment for said body portion positioned on said rear end portion of said operator's platform within said recess, and said roof support means extending over said recess and arranged to support the mine roof above said operator's compartment.

9. A mobile drilling machine as set forth in claim 1 which includes, a protective shield positioned on said front end portion of said operator's platform forwardly of and in surrounding relation with said roof drilling unit, said protective shield extending upwardly from said operator's platform and outwardly from beneath said roof support means, and said roof drilling unit being surrounded laterally and vertically by said protective shield and said roof support means.

10. A mobile drilling machine as set forth in claim 9 in which said protective shield includes, a plurality of support members secured to said operator's platform and extending upwardly in surrounding relation with said roof drilling unit, and a plurality of bars extending between said support members in generally vertically spaced relation to form a cage surrounding said roof drilling unit at said front end portion of said operator's platform.

* * * * *